US006209817B1

(12) United States Patent
Conrad et al.

(10) Patent No.: US 6,209,817 B1
(45) Date of Patent: Apr. 3, 2001

(54) METHOD AND APPARATUS FOR MONITORING A WINDING HARDNESS OF A WINDING ROLL

(75) Inventors: Hans-Rolf Conrad, Dormagen; Dirk Cramer, Duisburg, both of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/310,340

(22) Filed: May 12, 1999

(30) Foreign Application Priority Data

May 13, 1998 (DE) ..... 198 21 318

(51) Int. Cl.[7] ..... B65H 18/10; B65H 23/04

(52) U.S. Cl. ..... 242/534; 242/541.1; 242/413.9; 242/413

(58) Field of Search ..... 242/534, 541.1, 242/333.2, 413, 413.9; 226/24

(56) References Cited

U.S. PATENT DOCUMENTS

| | | | | |
|---|---|---|---|---|
| 3,721,809 | * | 3/1973 | Strandberg, Jr. et al. | 242/534 |
| 3,858,820 | * | 1/1975 | Crouse | 242/534 |
| 4,070,194 | * | 1/1978 | Arakawa . | |
| 4,496,112 | | 1/1985 | Olsson et al. . | |
| 4,722,490 | | 2/1988 | Doerfel . | |
| 4,817,883 | * | 4/1989 | Hoffmann et al. | 242/534 |
| 5,586,501 | * | 12/1996 | Burguera et al. . | |
| 5,709,331 | | 1/1998 | Lam et al. . | |

FOREIGN PATENT DOCUMENTS

| | | | | |
|---|---|---|---|---|
| 2256882 | | 12/1973 | (DE) . | |
| 2802466 | | 7/1979 | (DE) . | |
| 2915829 | | 10/1980 | (DE) . | |
| 4115406 | | 11/1992 | (DE) . | |
| 4321112 | | 1/1994 | (DE) . | |
| 19543246 | | 5/1996 | (DE) . | |
| 224898 | | 6/1987 | (EP) . | |
| 737638 | | 10/1996 | (EP) . | |
| 2117935 | | 10/1983 | (GB) . | |
| 59-158750 | * | 9/1984 | (JP) | 242/534 |
| 63-220924 | * | 9/1984 | (JP) | 242/413 |
| 61-23065 | * | 1/1986 | (JP) | 242/413 |

OTHER PUBLICATIONS

An article at pp. 76–78 of *Papier +Kunstoff Verarbeiter* (6–88), entitled "Wickeltechnologie unter besonderer Berucksichtigung von empfindlichen Spezialpapieren", by von Christian Gg. Enke.

An article at pp. 923–925 of *Wochenblatt fut Papierfabrikation* (22–1986), entitled "Wickelkriterien der perfekten Rolle", by P. Lang.

An article at pp. 23–28 of *Papier+Kunststoff Verarbeiter* (6–83), entitled "Bahndehnungsregelung mit Hilfe eines Drehwinkeldifferenz–Sensors" by Scheuter et al..

* cited by examiner

*Primary Examiner*—Katherine A. Matecki
(74) *Attorney, Agent, or Firm*—Greenblum & Bernstein, P.L.C.

(57) ABSTRACT

Method and apparatus for monitoring a winding hardness of a winding roll when winding a material web. A series of marks are placed on the material web at a first location as it is wound onto the winding roll. The distance between two successive marks is detected at a second location. The detected distance of two successive marks is used to determine a stretch of the material web.

26 Claims, 1 Drawing Sheet

METHOD AND APPARATUS FOR MONITORING A WINDING HARDNESS OF A WINDING ROLL

CROSS-REFERENCE TO RELATED APPLICATIONS

The present application claims priority under 35 U.S.C. § 119 of German Patent Application No. 198 21 318.2, filed on May 13, 1998, the disclosure of which is expressly incorporated by reference herein in its entirety.

BACKGROUND OF THE INVENTION

1. Field of the Invention

The invention is directed to a method and apparatus for monitoring a winding hardness of a material web wound onto a winding roll.

2. Discussion of Background Information

The present invention will be described below with respect to a material web, such as, for example, a paper web. However, it is understood that the invention is equally applicable to other types of web material without departing from the spirit and/or scope of the invention.

During an operation to produce a material web, such as, for example, paper web, the paper web is typically wound into saleable rolls, referred to as winding rolls. Generally, the paper web is wound onto a core, such as, for example, a cardboard tube. During this operation, it is desirable to achieve a winding hardness pattern in which the winding hardness decreases from a center to an outside.

Factors that influence a winding hardness include, but are not limited to, for example, a pressure with which the paper web is pressed against the winding roll, when the paper web encounters the winding roll, and a tensile stress wound into the paper web. In this regard, it is noted that the tensile stress can be changed (varied) by, for example, changing a driving torque (e.g., increasing or decreasing the driving torque) of an associated winding motor that forms the winding roll. In a king roll winder, in which the winding roll lies in a winding bed formed by a plurality of king rolls, a wound-in tensile stress can be changed by operating one drum winder, of a plurality of drum winders, at a speed (or torque) that differs from the speed (or torque) of the remaining drum winders.

Experience with winding rolls has yielded values that can be used to influence the winding hardness in a desired direction. However, it is very difficult to actually determine the winding hardness during a winding operation.

SUMMARY OF THE INVENTION

Accordingly, an object of the present invention is to develop an apparatus and method for monitoring a winding hardness of a material web wound onto a winding roll during a winding operation.

In the current invention, the term "stretch" refers to a change in length of a section of a paper web (or other web material) that is observable when a tensile force is applied to the material web. Most material webs can be stretched to a certain degree before they tear. The maximum amount the material may be stretched is dependent on the tensile stress of the section of the paper web to be stretched. The amount of stretch to which a paper web can be subjected is relatively small. However, if the properties of the paper web has been previously determined, the amount of stretch can be used as a reliable indication of the tensile stress to which the paper web is subjected. If one monitors the stretch on a continuous basis (or at predetermined discrete intervals), continuous (or quasi-continuous) information is obtained on the tensile stress to which the paper web is subjected during the winding operation. Thus, very reliable conclusions regarding the winding hardness of the material web roll can be reached.

It is especially advantageous if the change in the material web's length is determined between two measurement points having different tensile stresses. In the current application, the phrase "measurement point" is defined as a location where information is available on the length of a section of the material web. The amount of stretch of a section of material web is not monitored continuously, but rather, is based upon two measurements (or determinations of length). Typically, one measurement is made prior to the application of the tensile force, while the second measurement is made after the application of the tensile force (or, alternatively, after the tensile force has been raised). This reduces the measurement work. If such measurements (or determinations) are performed for several sections of the material web, information on the tensile stress of the web material is obtained with a desired continuity.

Preferably, the measurement points are separated from one another by a nip. A nip (or gap) between rolls leads to a decoupling of the tensile stress in the material web ahead of and behind the nip. As a result, the two states of the material web can be reliably separated from one another.

It is advantageous for the nip to be formed between the winding roll and a king roll. Then, it is not necessary to use any additional structural members to create the nip. This nip is available in any case and can be used for carrying out the measurement.

It is generally not practical to employ a physical contact device (e.g., a measuring device that contacts the paper web) to measure the stretch of the paper web during the winding operation. However, an optical measurement device can be used to measure the stretch of the paper web without physically contacting the paper web. Moreover, optical measurement devices are capable of measuring even relatively small changes (i.e. relatively small stretch in the material web).

In the preferred embodiment, the material web is provided with markings at predetermined spacings (or lengths). The markings facilitate the optical measurement of the stretch. The markings are detected (in the instant invention) using an appropriate measuring sensor. The markings are applied prior to the application of the tensile stress (or, at a location where a first tensile stress prevails). Then, when the tensile stress is applied (or changed), the markings stretch with the material web, so that the spacing between markings increase. By determining the spacing of the markings (or their length), one obtains information on the change in length, or stretch, of the material web with the change in tensile stress. One must then only ensure that the material web is actually wound with respect to the measured tensile stress.

The present invention discloses an apparatus and method that easily measures an amount of stretch at a section of the material web that rests on the winding roll. It is noted that the tensile stress can no longer change in this location. Furthermore, the measured tensile stress directly affects the winding hardness, so that the information on the tensile stress suffices to determine the course of the winding hardness.

After the amount of stretch has been determined, it is no longer necessary for the markings to remain on the surface of the material web. Accordingly, it is desirable that the markings disappear after the measurement is made. That is, it is desirable to use a marking material, such as, for example, an ink, that disappears after the passage of a predetermined time period, so as not to disfigure the appearance of the material web.

Thus, in the instant invention, the markings are created on the material web by applying an ink that turns invisible after a finite period of time. Such inks are known, for example, in the joke industry as "disappearing ink". Similar type inks are used by children and is called "magic ink". One such manufacturer of such inks in The Walter Toufar Gesellschaft, located at Herzgasse 39–41, A-1100 Vienna, Austria. This company produces various disappearing inks having different color intensities. In the preferred embodiment, the color intensity of the ink is selected based upon the optical sensitivity characteristics of the employed optical sensor. A shift in pH causes the ink to become, after the lapse of the finite period of time, a pure aqueous solution that evaporates. As a result, the ink does not contaminate the material web. In this regard, it is noted that the moisture of the ink placed on the material web does not adversely affect the quality/characteristics of the material web prior to its evaporation.

In the preferred embodiment, the ink evaporates and disappears in less than 15 minutes. This provides sufficient time to perform the measurement with the required precision. This time period is also short enough that there is no danger of delivering ink marked material web rolls. However, variations in this time period may occur without departing from the spirit and/or scope of the invention.

Preferably, the speed at which the material web is wound and the time interval (or length of time) of the markings are synchronously determined. With the time standards (e.g., timers) available today, such as, for example, quartz crystal oscillators, a time measurement can be performed with very high precision. Information on the length or spacing of the markings is obtained from the speed measurement of the material web. When the two quantities are combined, information on the length (or spacing) is easily determined.

Advantageously the tensile stress is regulated as a function of the determined stretch. Accordingly, if one does not want to achieve a constant winding hardness curve, one can specify a stretch curve to serve as a target value. The stretch determined as the actual value is compared to the target value. If the two values differ, the tensile stress is adjusted in order to bring the actual value and the target values back into agreement.

According to the instant invention, a method is disclosed for monitoring a winding hardness of a winding roll when winding a material web. A plurality of marks (such as, for example, disappearing ink marks) are placed on the material web, at a first location, as the material web is wound onto the winding roll. At a second location (such as, for example, a section of the material web that lies on the winding roll), a distance between successive marks of the plurality of marks placed on the material web is detected. Thereafter, a stretch of the material web is determined based upon the detected successive marks. The ink becomes invisible after the elapse of a certain time, such as, for example, five to fifteen minutes.

According to a feature of the invention, a change in length in the material web between two measurement points is determined.

According to another feature, a nip is located between the two measurement points. In the preferred embodiment, the nip is formed between the winding roll and a king roll.

An advantage of the invention is that an optical sensor is employed to detect the distance between the successive marks at the second location.

According to another advantage of the invention, the amount of stretch of the material web is determined in accordance with a formula (d2–d1), in which d1 corresponds to a spacing between the successive marks placed on the material web at the first location, and d2 corresponds to a spacing between the successive marks at the second location.

Another advantage of the invention pertains to the travel speed of the material web and a time interval of the placing of the plurality of marks being synchronously determined.

Based upon the determined stretch of the material web, a tensile stress can be regulated.

According to another object of the invention, an apparatus that monitors a winding hardness of a winding roll when winding a material web comprises a marking device that places a plurality of marks on the material web at a first measuring point as the material web is wound onto the winding roll, a detector that detects a distance between successive marks of the plurality of marks placed on the material web at a second measuring point, and a determining device that determines a stretch of the material web based upon a change in spacing of the detected successive marks.

According to a feature of this invention, the marking device comprises an ink dispensing device that uses an ink, such as a disappearing ink, to place the plurality of marks on the material web. The disappearing ink disappears after the passage of a certain time. The determining device determines the stretch based upon the formula d1–d2 where d1 corresponds to a spacing between the successive marks placed on the material web at the first measuring point, and d2 corresponds to a spacing between the successive marks at the second measuring point.

According to another feature of the invention, the detector comprises an optical detector.

According to an advantage of the invention, a rotational speed controller is provided that adjusts a winding speed of the winding roll, in accordance with a determination by the determining device, to obtain a desired stretch. The rotational speed controller adjusts a winding speed of the winding roll in response to a signal output by the determining device.

According to a still further object of the instant invention, a method is disclosed for monitoring a winding hardness of a material web wound onto a winding roll. The method comprises placing a plurality of marks on the material web, in which the plurality of marks are spaced apart from each other by a predetermined spacing. The marks comprise, for example, colored ink marks that disappear after a certain time, such as, for example, fifteen minutes, after the ink is applied to the material web. At a predetermined measuring point, a change in the spacing of the plurality of marks on the material web, as the material web is wound onto the winding roll, is detected. As a result, an amount of stretch of the material web, based upon the detected change in the spacing of the plurality of marks is determined.

According to a feature of this object, a tensile stress of the material web is regulated in accordance with the determined stretch amount.

According to a still further feature of the invention, the plurality of marks are placed on the material web when the material web is proximate (e.g., in the vicinity of) a guide arrangement.

According to an advantage of this invention, a sensor, such as, for example, a speed sensor, determines a travel speed of the winding roll.

BRIEF DESCRIPTION OF THE DRAWINGS

The present invention will be further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of an example and for purposes of illustrative discussion of the present invention only and are presented in the course of providing what is believed to be the most useful and readily understood description of the principles and conceptual aspects of the present invention. In this regard, no attempt is made to show structural details of the present invention in more detail than is necessary for the fundamental understanding of the instant invention, the description taken with the drawings making apparent to those skilled in the art how the several forms of the present invention may be embodied in practice.

Figure 1:
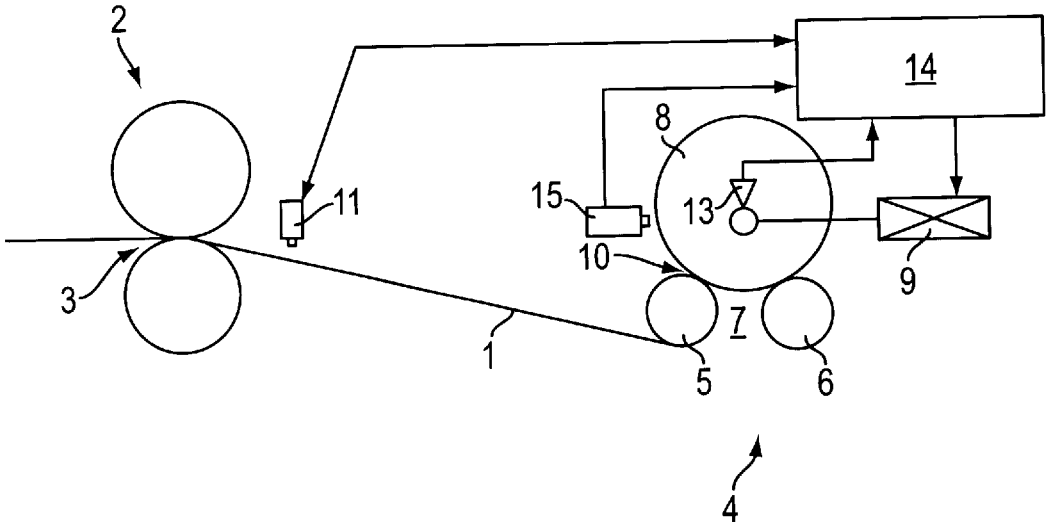
FIG. 1 schematically illustrates an arrangement for winding a material web roll.

As shown in FIG. 1, material web 1 passes through a guide arrangement 2, formed by a pair of rollers 2*a* and 2*b*. A first nip (or gap) 3 is located between the pair of rollers and guides the material web 1 towards a winding station 4. The winding station 4 comprises a first king roll 5 and a second king roll 6 that form a winding bed 7, in which a winding roll 8, onto which the material web 1 is wound, lies. In the preferred embodiment, the winding station 4 is located behind a cutting device, which is not shown in detail. However, it is understood that the exact location of the winding station 4 may be varied without departing from the spirit and/or scope of the invention.

The winding roll 8 is driven by motor 9. The motor 9 generates a torque that is applied to the winding roll 8 to wind the material web 1 thereon.

In the disclosed embodiment, the material web 1 loops around the first king roll 5 (e.g., changes it's travel direction by approximately 180°) and passes through a second nip 10 that is located between the winding roll 8 and the first king roll 5. The second nip 10 functions to decouple the tensile stress, in a first region between the guide arrangement 2 with the first nip 3 and the first king roll 5, from the tensile stress generated on a surface of the winding roll 8 by the motor 9.

The tensile stress in the first region has a value F1. The tensile stress in the material web 1 in an uppermost layer of the winding roll 8 (e.g., the layer that rests upon the surface of the winding roll 8), exhibits a tensile stress having a value F2. The tensile stress F1 is known. For example, in the disclosed embodiment, the tensile stress F1 is equal to zero when the guide arrangement 2 and the king roll 5 are driven with the same circumferential speed. On the other hand, tensile stress F2 varies, since it is substantially dependent on the torque generated by the motor 9.

In the disclosed embodiment, the travel speed (e.g., rate of travel) of the material web 1 is determined using a speed sensor 13 that measures the rotational speed of the winding roll 8 and a diameter of the wound material web 1. However, it is understood that other measuring techniques/sensors may be employed for determining the travel speed of the material web 1 without departing from the spirit and/or scope of the instant invention.

In order to determine the tensile stress F2, an inking device 11 is positioned at a first location, such as, for example, between the first nip 3 and the first king roll 5. In the disclosed embodiment, the inking device 11 is located proximate the first nip 3. The inking device 11 creates colored ink dots 12 (see FIG. 2) that are spaced apart by a predetermined distance d1. The time spacing with which the inking device 11 applies the ink dots 12 on the material web 1 yields a first value that is fed to a controller 14. In this regard, it is understood that one can alter the described arrangement (without departing from the spirit and/or scope of the invention) to, for example, have the controller 14 drive the inking device 11 at predetermined time intervals, so that the inking device 11 applies ink dots to the material web 1 that are spaced by the distance d1.

The location of the inking device 11 designates a first measurement point where the length of a section of the material web 1 is to be determined. In the current invention, the term "determining" means that the information on the length of this section of the material web 1 is available after passage through the first measurement point. The information is also available when the length is first determined at this measurement point.

Figure 2:
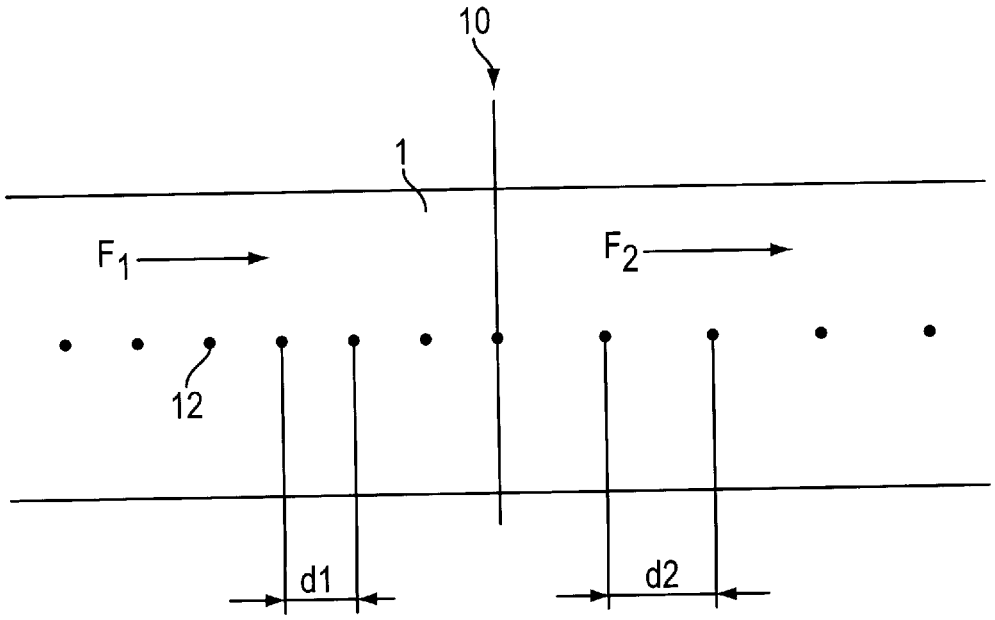
FIG. 2 illustrates a schematic representation to explain how a tensile stress is determined.

When tensile stress F2 is greater than tensile stress F1, the material web 1 stretches. This is represented in FIG. 2 by increased distance d2 between successive ink dots 12. That is, when the material web 1 stretches, the distance d2 between two ink dots 12 increases in comparison to the distance d1 between two ink dots 12.

In the disclosed embodiment, the distance between the ink dots 12 is determined using a color measuring device 15 positioned at a second location (second measuring point). The color measuring device 15 optically detects the colored ink dots 12 formed on the material web 1. The color measuring device 15 of the disclosed embodiment measures the time that elapses between the passage of two successive ink dots 12, and provides this information to the controller 14.

While the disclosed embodiment discloses a measuring device 15 that detects the time period between successive ink dots 12, it is understood that substitutions, alternations and variations to the measuring device 15 may be made without departing from the spirit and/or scope of the invention.

The tensile stress F2 in the topmost layer of the winding roll 8 behind the second nip 10 is determined (in the disclosed embodiment) in accordance with the following relationship:

$$(d2-d1)=c\cdot(F2-F1),$$

where "c" represents a predetermined constant value.

When F1 is equal to zero, the tensile stress F2 is easily calculated from the above formula. The value of the predetermined constant "c" is dependent on the values of the material web 1, and are empirically determined beforehand based upon a laboratory test.

It is noted that while the disclosed embodiment teaches the use of colored ink dots 12, other types/forms of markings may be employed without departing from the spirit and/or scope of the invention. For example, the ink dots 12 can be replaced by dashes that run parallel to a run direction of the material web 1. The information on the stretch that has occurred is obtained based upon a comparison of the length of the dashes before the first nip 10 and after the first nip 10.

After the material web 1 passes through the second measurement point (e.g., the point where the color measuring device 15 is located), the ink dots 12 (or other markings) are no longer required. For this reason, it is desirable to use an ink for the ink dots 12 that becomes invisible after the passage of a certain time period. As discussed above, such an ink is produced by, for example, Walter Toufar Gesellschaft, located at Herzgasse 39–41, a-1100, in Vienna, Austria.

The pH value of the ink changes after the ink strikes the material web. As a result, the ink becomes a pure aqueous solution that evaporates with the passage of time. After a certain time, for example, approximately five minutes, elapses, no more impurities (or ink residue) can be perceived on the web.

While the present invention discloses the use of an ink that evaporates (disappears) after approximately five minutes, it is understood that inks with different disappearing properties (e.g., inks that disappear in less than five minutes or more than five minutes, such as, for example, fifteen minutes) may be used without departing from the spirit and/or scope of the instant invention; the important feature being that the ink placed on the material web 1 eventually disappears or becomes invisible, so as to avoid disfiguring of the material web 1.

The tensile stress has a direct effect on the winding hardness of the winding roll 8. In the disclosed embodiment, the controller 14 employs a predetermined tensile stress curve to control a desired tensile stress. Alternatively, the controller 14 can, for example, employ a stored stretch curve. The controller 14 selects the tensile stress curve as a target value, and selects the stretch curve determined by the color measuring device 15 as an actual value. The motor 9 (or associated drive mechanism, which is not illustrated in the drawings) is then controlled so that the measured curve agrees with the predetermined curve. In this way, it is possible to influence the winding hardness curve in a desired way with relatively little effort.

It is noted that the foregoing example has been provided merely for the purpose of explanation, and in no way is to be construed as limiting the present invention. While the present invention has been described with reference to an exemplary embodiment, it is understood that the words which have been used herein are words of description and illustration, rather than words of limitation. Changes may be made, within the preview of the appended claims, as presently stated and as amended, without departing from the scope and/or spirit of the instant invention in its aspects. Although the present invention has been described herein with reference to particular means, materials and embodiments, the present invention extends to all functionally equivalent structures, methods and uses, such as are within the scope of the appended claims.

We claim:

1. A method for monitoring a winding hardness of a winding roll when winding a material web, comprising:

placing a plurality of marks, at a first location, on the material web as the material web is wound onto the winding roll;

detecting, at a second location, a distance between successive marks of the plurality of marks placed on the material web; and determining a stretch of the material web based upon the detected successive marks.

2. The method of claim 1, wherein the determining of the stretch of the material web comprises determining a change in length in the material web between two measurement points.

3. The method of claim 2, further comprising locating a nip between the two measurement points.

4. The method of claim 3, wherein the locating of the nip comprises forming the nip between the winding roll and a king roll.

5. The method of claim 1, wherein the detecting of the distance between successive marks at the second location comprises optically detecting the distance between the successive marks at the second location.

6. The method of claim 1, wherein the determining of the stretch comprises determining the stretch in accordance with the following formula:

$$(d2-d1),$$

where d1 corresponds to a spacing between the successive marks placed on the material web at the first location, and d2 corresponds to a spacing between the successive marks at the second location.

7. The method of claim 6, wherein the second location lies proximate the winding roll.

8. The method of claim 1, wherein the placing of a plurality of marks on the material web comprises applying an ink to the material web.

9. The method of claim 8, wherein the ink becomes invisible over time.

10. The method of claim 9, wherein the ink becomes invisible in less than fifteen minutes.

11. The method of claim 1, further comprising synchronously determining a travel speed of the material web and a time interval of the placing of the plurality of marks.

12. The method of claim 1, further comprising regulating a tensile stress in the material web in accordance with the determined stretch.

13. The method of claim 12, wherein the determining of the stretch comprises determining the stretch in accordance with the following formula:

$$(d2-d1),$$

where d1 corresponds to a spacing between the successive marks placed on the material web at the first location, and d2 corresponds to a spacing between the successive marks at the second location.

14. An apparatus that monitors a winding hardness of a winding roll when winding a material web, comprising:

a marking device that places a plurality of marks on the material web at a first measuring point as the material web is wound onto the winding roll;

a detector that detects a distance between successive marks of the plurality of marks placed on the material web at a second measuring point; and a determining device that determines a stretch of the material web based upon a change in spacing of said detected successive marks.

15. The apparatus of claim 14, wherein said marking device comprises an ink dispensing device containing an ink to place said plurality of marks on the material web.

16. The apparatus of claim 15, wherein said ink comprises a disappearing ink.

17. The apparatus of claim 14, wherein said detector comprises an optical detector.

18. The apparatus of claim 14, wherein said determining device determines said stretch based upon the following formula:

$$(d2-d1),$$

where d1 corresponds to a spacing between said successive marks placed on said material web at said first measuring point, and d2 corresponds to a spacing between said successive marks at said second measuring point.

19. The apparatus of claim 18, further comprising a rotational speed controller that adjusts a winding speed of said winding roll, in accordance with a determination by said determining device, to obtain a desired stretch.

20. The apparatus of claim 18, further comprising a rotational speed controller that adjusts a winding speed of said winding roll in response to a signal output by said determining device.

21. A method for monitoring a winding hardness of a material web wound onto a winding roll, comprising:

placing a plurality of marks on the material web, said plurality of marks being spaced apart from each other by a predetermined spacing;

detecting, at a predetermined measuring point, a change in the spacing of the plurality of marks on the material web as the material web is wound onto the winding roll; and determining an amount of stretch of the material web, based upon the detected change in the spacing of the plurality of marks.

22. The method of claim 21, further comprising:

regulating a tensile stress of the material web in accordance with the determined stretch amount.

23. The method of claim 21, further comprising placing the plurality of marks on the material web when the material web is proximate a guide arrangement.

24. The method of claim 21, further comprising a sensor that determines a rotational speed of the winding roll.

25. The method of claim 21, wherein the placing of the plurality of marks on the material web comprises placing a plurality of ink marks on the material web.

26. The method of claim 25, wherein the placing of ink marks on the material web comprises placing a plurality of ink marks on the material web that disappear after the elapse of time.

* * * * *